United States Patent [19]

Kirkendall

[11] 4,089,817

[45] May 16, 1978

[54] ANTENNA SYSTEM

[75] Inventor: Dennis Kirkendall, Dayton, Ohio Dayton, Ohio 45415

[73] Assignee: Stephen A. Denmar, Dayton, Ohio

[21] Appl. No.: 731,732

[22] Filed: Oct. 12, 1976

[51] Int. Cl.[2] ..... H01Q 1/32

[52] U.S. Cl. ..... 343/713; 343/850; 361/290; 361/292

[58] Field of Search ..... 343/713, 850; 361/290, 361/292

[56] References Cited

U.S. PATENT DOCUMENTS

| | | | |
|---|---|---|---|
| 1,608,085 | 11/1926 | Douglas | 361/290 |
| 1,715,952 | 6/1929 | Rostron | 343/850 |
| 1,740,159 | 12/1929 | DuBilier | 361/290 |
| 2,829,367 | 2/1953 | Rychlik | 343/850 |
| 3,728,641 | 4/1973 | Fujita | 361/292 |

OTHER PUBLICATIONS

Dummer, G.W.A. Variable Capacitors and Trimmers, Sirisacc Pitman & Sons, Ltd., London, 1957, pp. 108–109.

*Primary Examiner*—Alfred E. Smith
*Assistant Examiner*—Harry Barlow
*Attorney, Agent, or Firm*—C. Walter Mortenson

[57] ABSTRACT

An installation for an antenna, particularly advantageous for use in connection with a transceiver in a mobile vehicle, comprising first and second means, each of which includes electrically conductive material, adapted to be fixed, without need for mechanical fasteners, in facing relation and in respective connection with inner and outer surfaces of a portion of a structure capable of providing a dielectric therebetween, the one of said means connecting to said outer surface providing for mount of an antenna in connection with the electrically conductive material thereof which forms one plate of a capacitor, the opposite plate of which is provided by the electrically conductive material of the other of said means which connects to said inner surface, and the said means which connects to said inner surface including means for coupling of the electrically conductive material thereof to conductive means in connection with said transceiver. In preferred embodiment and application, the means which connects to said inner surface and includes said other plate of said capacitor is so comprised as to provide for fine tuning of the antenna system of which it forms a part.

14 Claims, 6 Drawing Figures

FIG-1
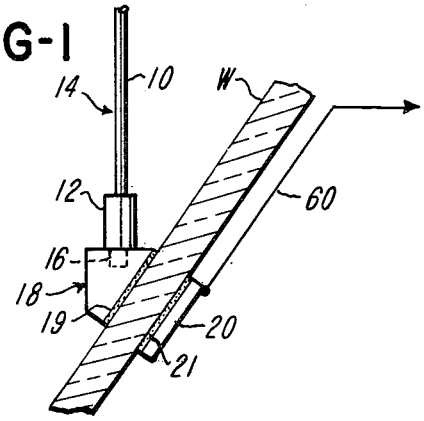
FIG-2
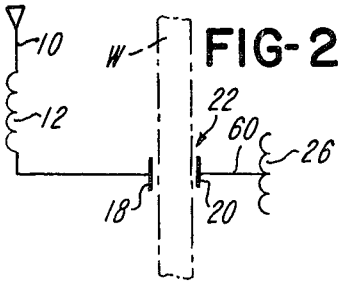
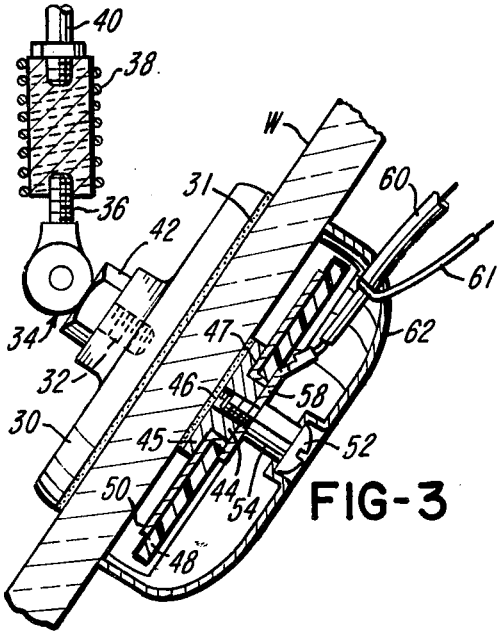
FIG-3
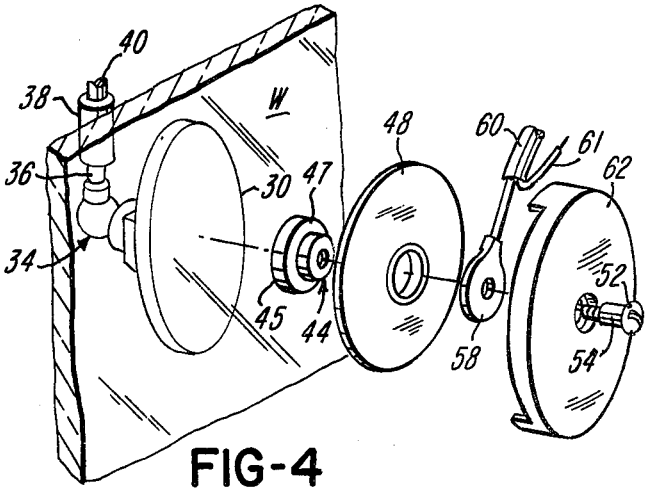
FIG-4
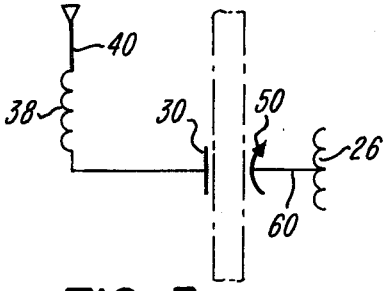
FIG-5
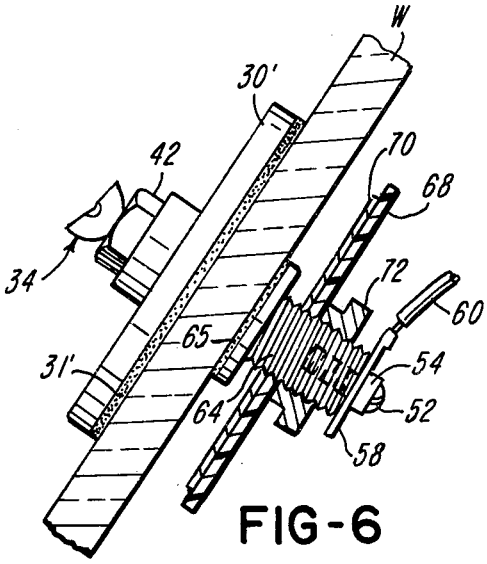
FIG-6

ANTENNA SYSTEM

BACKGROUND OF THE INVENTION

This invention relates to improvements in means and methods for mounting and tuning a whip type antenna in connection with a mobile, high frequency transceiver.

The typical whip type antenna comprises a length of stiff wire or rod mounted to project upwardly and outwardly from the vehicle in which the related transceiver is employed. A conventional installation of such an antenna normally requires the formation of apertures in or other defacement of the vehicle to which it mounts and/or the application of special fasteners. The fasteners employed are oftentimes in locations which make them difficult to manipulate, correspondingly making the antenna difficult to install.

A whip type antenna may embody a loading coil which is electrically attached, either intermediate the length thereof or at its base. The function of this coil is to make the antenna seem longer to the coaxial cable connecting the antenna system to the transceiver, hopefully to thereby increase its efficiency. It has, in any case, been quite a problem to tune such an antenna, with or without the loading coil. Good tuning facility has been very difficult to achieve since the tuning requirements vary from vehicle to vehicle in which the antenna may be embodied and therefore cannot be preset. The normal method of tuning is to clip off short lengths of the antenna, after it is installed, until it appears that optimum performance of the system has been reached. The potential quality of performance of the antenna system is determined during the tuning procedure by applying an SWR meter to the coaxial cable which extends between the transceiver and the antenna. As must be readily acknowledged, this method of tuning antenna systems is awkward and time consuming. Since tuning is normally a matter of "cut and try", oftentimes too much of the antenna is cut off, in which event the antenna must be replaced.

To tune an antenna system one might in a case of a loaded type antenna try to vary the inductance of the loading coil. This, however, is mechanically difficult. One might also incorporate in the antenna system a series variable capacitor, which would act to cancel some of the inductance of the loading coil. This last has not been done because of the expense and the physical incompatability of a variable capacitor on the exterior of a vehicle.

It is to the elimination of the aforementioned tuning and mounting problems that the present invention is directed.

SUMMARY OF THE INVENTION

The present invention affords improvements in antenna systems for transceivers and in the mount of the included antenna. As embodied in a vehicle, the invention provides for an antenna to mount to means defining one metal plate which is adhesively attached to the exterior surface of a windshield, for example, while means including a second metal plate is mounted in facing relation to the first plate and in connection with the interior surface of the windshield. Since the windshield is a dielectric, in the application thereof the two plates form therewith a feed thru capacitor. The plate located at the interior surface of the windshield is provided with means for the electrical coupling thereof to a coaxial cable such as provided in connection with a transceiver. By such means one not only achieves a simple and economical means and method for mounting an antenna to a windshield but an improved antenna system which in preferred embodiments may be readily modified so as to be capable of being finely tuned.

The installation provided by the invention features the fact that its application requires neither defacement of the vehicle structure nor special fasteners or tools. A special bonus is that the invention enables the mount of an antenna in proximity to a transceiver, thus avoiding the need for extensive and sometimes difficult wiring and such problems incident thereto as are normally experienced in the conventional mount and connection of a whip type antenna to a transceiver.

Preferred embodiments of the invention which utilize a basic arrangement for installing an antenna similar to that above described incorporate improved means for tuning the antenna. When included, fine tuning capacity is provided in connection with the interiorly mounted portion of the feed thru capacitor. In one embodiment thereof conductive portions of the installation which form the two plates of the feed thru capacitor are provided with a non-circular peripheral configuration and one thereof is mounted to be rotatively adjustable, in place, relative the other. This arrangement provides for a variable overlap of the facing capacitor plates which are separated by the windshield. As will be obvious, this affords an exceedingly simple means and method for the fine tuning of the antenna system of which the capacitor plates form a part. As an alternative, one of the capacitor plates may be mounted to enable an axial displacement thereof with reference to the other. This latter arrangement is productive of another fine tuning system. A third arrangement for fine tuning embodying the features of the present invention involves a combination of the essential features of the first and second arrangements above briefly described. In this latter case a shunt capacitor is interrelated to function mutually with the feed thru capacitor in an arrangement the specifics of which facilitate extremely sharp tuning.

It is accordingly a primary object of the invention to provide improvements in means and methods for the mounting and/or fine tuning of an antenna system in connection with a transceiver having special advantage in connection with the installation of a mobile communications unit in a vehicle.

Another object of the invention is to provide means for mounting a whip type antenna to a vehicle which requires neither defacement of the vehicle nor the application or manipulation of mechanical fasteners.

A further object of the invention is to provide an improved antenna system for a mobile transceiver unit including a simple but highly effective arrangement for fine tuning thereof.

An additional object of the invention is to provide an improved antenna system for a transceiver unit comprising means defining two electrically conductive metal plates (or their equivalent) which may be mounted to a windshield or window by means requiring no apertures or mechanical fasteners, one of which plates is mounted to be adjustable relative the other to provide a simple arrangement for fine tuning such system.

Another object of the invention is to provide means and methods for mounting an antenna in connection with a mobile vehicle and connecting it to a transceiver within the vehicle possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein some but not necessarily the only forms of embodiment and application of the invention are illustrated, FIG. 1 is a generally diagrammatic view of a basic installation of an antenna embodying features of the present invention;

FIG. 2 is a schematic referenced to the installation of FIG. 1;

FIG. 3 illustrates a preferred embodiment of the invention, parts thereof being shown in cross section and in connection with the windshield of an automotive vehicle;

FIG. 4 is an exploded view giving greater detail of certain parts of the structure of FIG. 3;

FIG. 5 is a schematic referenced to the embodiment of FIGS. 3 and 4;

FIG. 6 illustrates a further embodiment of the invention;

Figure 7:
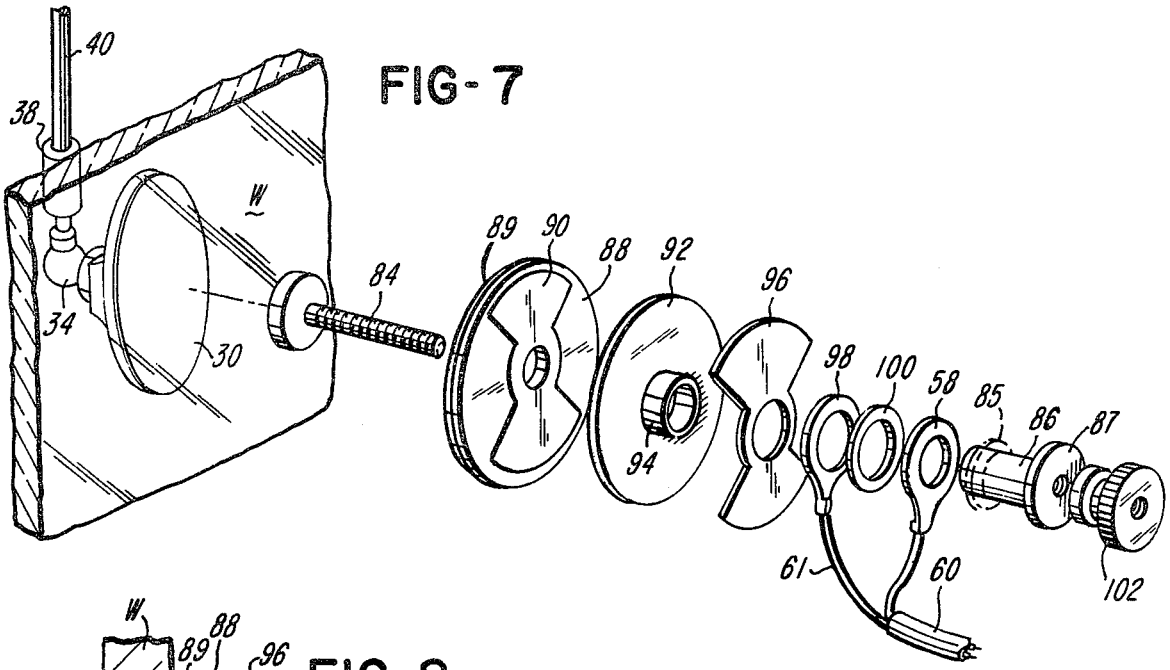
FIG. 7 is an exploded view of components of yet another embodiment of the invention.

While in the description of each embodiment here illustrated the antenna will be referred to as incorporating in connection therewith a loading coil, it is to be understood that the benefits inherent in the use of the features of the present invention will accrue whether or not the antenna incorporates a loading coil.

FIG. 1 illustrates a most basic embodiment and application of the concepts of the present invention as used in connection with a transceiver in a mobile vehicle, the vehicle being represented by a fragment of its windshield W. To comprehend the total benefits of the invention and its use it must be realized that in such an application the transceiver is usually mounted in connection with the dashboard of the vehicle, immediately under and adjacent to its windshield.

As shown, a whip type antenna 10 includes at the base thereof a loading coil 12 which forms therewith an antenna assembly 14. An axial projection at the base of the antenna assembly is in the nature of a threaded stud 16.

A block 18 fabricated of electrically conductive material includes, in the case illustrated, in the top thereof, a recess suitably configured for the threaded engagement therein of the stud 16. Per the present invention, using a layer 19 of a suitable epoxy or its equivalent, the block 18 is shown as adhesively attached to the outer surface of the windshield W. The block 18, which is electrically coupled to the antenna 10 by way of the loading coil 12 and the stud-like projection 16 at its base, forms one plate of a capacitor 22, the opposite plate of which is provided by a block or plate 20 of electrically conductive material. As seen, using a layer 21 of adhesive, the block 20 is attached to the interior surface of the windshield W, in an opposed directly facing relation to the block 18. As interposed, the windshield W, which is fabricated of either glass or plastic, provides a dielectric between the blocks 18 and 20 which form therewith the feed thru capacitor 22 which on mount of the antenna assembly 14 to the block 18 is placed in series relation therewith (FIG. 2).

Suitable means are attached to the block 20 to enable the electrical coupling thereto of the center conductor of a coaxial cable 60 such as normally provided with the transceiver 26 embodied in the vehicle of which the windshield W forms a part.

The installation shown in FIG. 1 is easily achieved without need for special knowledge, without a requirement for defacement of the windshield and without a need for special fasteners or fastening arrangements. Since the arrangement provided enables a quick and easy installation of the block 18 in direct connection with any portion of the windshield W, the arrangement may provide that the interiorly located plate of the capacitor 22 may be placed in immediate proximity to the related transceiver. In this way the wiring requirements for effecting the installation of the antenna system in connection with the transceiver are absolutely minimized. Further, special note should be taken of the fact that all wire terminations are located interiorly of the vehicle to which the installation is applied. As a result, corrosion of terminals during the life of the installation is highly unlikely.

While the basic embodiment of the invention illustrated in FIGS. 1 and 2 exhibits significant features of improvement over the prior art, particularly as related to antenna systems and installations thereof in connection with a mobile transceiver unit (though not necessarily so limited in application), a preferred embodiment such as illustrated in FIGS. 3–5 is even more desirable.

The installation of FIGS. 3–5 is also shown in connection with the windshield W of an automotive vehicle which embodies a transceiver 26 such as described in the first instance. In this case the invention embodiment is shown to include a plate 30 of electrically conductive material which has applied to one face thereof a layer of adhesive 31 by means of which it is seated and affixed to an exterior surface portion of the windshield W. At the opposite or outermost face of the plate 30 is an interiorly threaded annular projection. The latter is threadedly engaged by a screw formed extremity of one arm 32 of a jointed coupling member 34, the other arm 36 of which is similarly formed and threadedly engaged in one end of a body forming part of a loading coil 38. As seen, the opposite end of this body portion of the coil 38 is threadedly engaged by an externally threaded axially projected stud on the lower end portion of a whip type antenna 40. Once the plate 30 is adhesively attached to the outer surface of the windshield, the antenna assembly comprised of the antenna 40, coil 38, and the jointed coupling member 34 may be quickly and easily secured in connection therewith and suitably positioned. A nut 42 shown in threaded engagement about the portion 32 of the coupling 34 serves as a positioning and limiting as well as a clamping member in a manner believed obvious.

Noting FIGS. 3 and 4, fixed to project inwardly of and perpendicular to the interior surface of the windshield W, in centered, relatively opposed, facing relation to the plate 30 is a tubular stud-like element 44. The one end of the element 44 which seats to the windshield has an external flange 45 which defines its base. This flange base of the element 44 is attached to the windshield by means of an interposed layer 46 of a suitable adhesive the nature of which has been previously described. The flange 45 provides a shoulder 47 which faces inwardly of the vehicle of which the windshield forms a part.

Mounted for free rotation on and about the stud 44 is a plastic plate 48 of disc-like circular configuration having a central aperture accommodating the projection therethrough of the innermost end of the stud 44. An elliptically configured plate-like layer 50 of copper material is centered and fixed in overlying covering relation to the face of the plate 48 which is most adjacent the windshield W. The elliptical plate-like overlay 50 is extended at its inner periphery to overlay also the surface of the plate 48 which defines its central aperture and it is thereby conductively and bearingly related to the stud 44 which is also made of electrically conductive material. The outer peripheral edge of the elliptically configured layer 50 falls just short, at its maximum diameter, of the outer peripheral edge of the plate 48. As will be seen, this enables ready manipulation of the unit 48–50 by the fingers of an operator without a touching of the metal overlay. In this embodiment the plate 30, which is of electrically conductive material and the plate-like overlay 50 on the plate 48 have an identical elliptical configuration the purpose of which will be further described.

The stud 44 is in this case interiorly threaded and the length of the portion thereof projecting inwardly from the shoulder 47 will approximate in dimension the thickness of the plate unit comprised of the element 48 and its plate-like overlay 50. A screw 52 engaged in the inwardly projected extremity of the stud 44 mounts thereon a spacer sleeve 54 one end of which abuts its head. In the application of this screw 52, its threaded extremity, beyond the spacer sleeve 54, as shown, may be thrust through a central opening in a cup-shaped plastic cap 62 and then through an annular eyelet 58 of the center conductor of a coaxial cable 60 in connection with the transceiver mounted in the vehicle of which the windshield W forms a part. As seen, moreover, as the threaded extremity of the screw is threadedly engaged in the stud 44 it may be turned inwardly thereof to clamp the eyelet at the end of the coaxial cable in abutting conductive relation to the inner projected extremity of the stud. Further illustrated in FIG. 3 is the ground lead 61 in connection with the coaxial cable 60. This lead 61 will be electrically coupled to a vehicle ground in close proximity to the assembly mounted on the stud 44.

Particular note should be taken of the fact that the shape of the cap 62 is such to provide openings laterally thereof accommodating the projection therethrough of peripheral edge portions of the plate 48. This facilitates the manipulation of the plate 48 and its plate-like overlay 50 as and when required.

The embodiment of the invention illustrated in FIGS. 3 and 4 not only provides a simple and improved means and method of mounting and connecting an antenna to a transceiver in a mobile vehicle but it affords a simple and economical means to facilitate a fine tuning of the antenna system so provided. Prior to the clamping of the eyelet 58 to the inwardly projected extremity of the stud 44 and thereby to have its outer peripheral portion in fixed frictional clamping engagement to the plate 48, which is thereby fixed against the shoulder 47, one may by a selective rotation of the plate 48 and its superposed plate-like overlay 50 relative to the opposing surface of the area of plate 30 vary the overlap of the respectively adjacent capacitor plates provided by the portions 30 and 50 of the installation. In this manner one may fine tune the system to a degree believed obvious.

The structural arrangement and method for tuning an antenna system as here provided in FIGS. 3–5 is quite simple. Nevertheless, it can provide fine tuning with little susceptibility to the effects of stray capacitance while the operator is tuning the system. It unquestionably affords a much better alternative to either tuning by clipping sections of an antenna after it has been installed or tuning by trying to vary the value of the inductance of the loading coil, if one is provided in connection with the antenna. While it is possible to incorporate a variable capacitor in direct connection with the loading coil, this is generally not feasible, not only because of the expense but because of their normal incompatibility found to exist where efforts are made to combine them exterior to a vehicle.

The windshield mounted antenna installation of FIGS. 3–5 provides not only a variable capacitance method of tuning but an antenna system the control of which is provided at the interior of the vehicle. On a simple application of his or her fingers to the portions of the plate 48 which project laterally and outwardly of the cap 62, to change the orientation of the metallic overlay 50 relative the opposing surface of the plate 30, an operator within the vehicle may tune as and when necessary while simultaneously operating the transceiver and at the same time reading the SWR meter conventionally applied in the tuning procedure.

FIG. 6 shows a modification of the embodiment of FIGS. 3–5 wherein the assembly in connection with the interior surface of the windshield W comprises a stud 64 the general configuration of which is the same as that of the stud 44 except that it has an external thread. Here the unit 48–50 is replaced by an annular plastic disc 68 including a copper plate-like overlay 70 at the face thereof to be placed adjacent the windshield W. This overlay is extended into the portion of the disc 68 which defines its central aperture and which is in this case threaded, thereby providing for the threaded engagement of the unit 68–70 over the inwardly projected extremity of the stud 64, the flanged head end of which is secured to the inner surface of the windshield W by means of an interposed layer 65 of a suitable adhesive. In this way the plate-like overlay 70 which has an annular disc-like configuration is positioned in adjacent parallel relation to the interior surface of the windshield W and in directly opposed facing relation to a metal plate 30' formed similarly to the plate 30 except that it may have a disc-like configuration. The plate 30' is fixed, through the medium of an interposed layer 31' of adhesive, to the exterior surface of the windshield W in a directly opposed generally parallel facing and aligned relation with the plate-like overlay 70. As noted, the plate 30' differs from the plate 30 only in its outer peripheral configuration and the configuration and the mounting thereto of an antenna assembly will be as described with reference to the comparable items of FIGS. 3–5.

It will be obvious that the unit 68–70 may be rotated on the stud 64, as a result of which it will move axially of the stud and have the displacement between the plate-like overlay 70 and the facing plate 30' vary in accordance therewith. This enables a tuning of the antenna system incorporating this modification of the invention. Once the position of the unit 68–70 is established by the operator in a tuning procedure, a jam nut 72 threaded on the stud 64 may be turned up to fix the position of the unit 68–70 along the stud.

In the case of the embodiment of FIG. 6 of the drawings, the assembly to the interior side of the windshield W may be completed utilizing the screw 52, spacer sleeve 54 and cap 62 to apply and connect the eyelet 58 of the center conductor of a coaxial cable 60 in conductive relation to the stud 64 and the plate-like element 70 of the unit 68–70 as previously described with reference to FIGS. 3–5.

Accordingly, the basic difference between the embodiments of FIGS. 3 and 5 and FIG. 6 is that in the latter case tuning is achieved by changing the spacing between the plates of the feed thru capacitor defined by the plate-like element 70 and the plate 30′ to the respectively opposite sides of the windshield W. In the FIG. 6 installation the plates of the capacitor are similarly configured so the facing or overlapped portions thereof will not change as the spacing therebetween is changed during a tuning operation.

Figure 8:
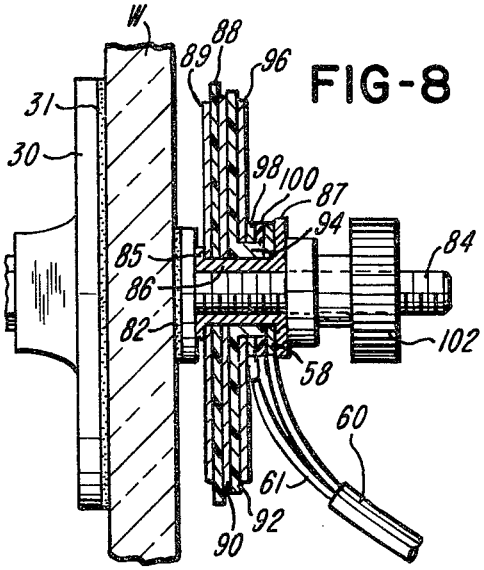
FIG. 8 is a side elevation view of the elements of FIG. 7, illustrated in an assembled relation.
Figure 9:
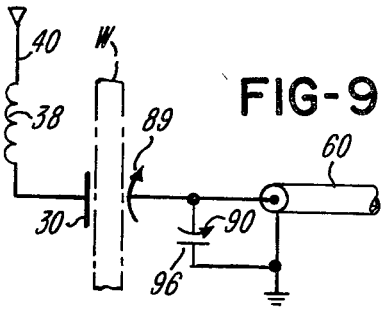
FIG. 9 is a schematic referenced to the installation of the embodiment of FIGS. 7 and 8.

A most advantageous embodiment of the invention, as far as fine tuning is concerned, is shown in FIGS. 7–9 of the drawings. Here a feed thru capacitor is placed in series with an antenna assembly as in the case of the embodiment of FIGS. 3–5 but in addition thereto a shunt capacitor is placed across the main and ground conductors of the coaxial cable which extends from the related transceiver. Also in this case both capacitors are variably adjustable. The portion of this embodiment which is affixed exterior to the windshield W may be as previously described with reference to the comparable portion of the embodiment of FIGS. 3 and 5. Accordingly, the exterior portion of this embodiment need not be further described in detail. Suffice it to say that the exterior plate 30 of the feed thru capacitor here provided will be adhesively affixed to the exterior surface of the windshield W by interposing therebetween a layer 31 of adhesive. For the interior portion of this embodiment reference is made to FIGS. 7 and 8 of the drawings. As shown, fixed to the interior surface of the windshield W in centered facing relation to the plate 30 which has an elliptical peripheral configuration, by means of an interposed layer 82 of adhesive, is the expanded head end of an externally threaded solid stud 84. The threaded body of the stud 84 is arranged to project inwardly from and perpendicular to the interior surface of the windshield in a coaxial relation with the plate 30. Threadedly engaged about and for movement longitudinally of the body of the stud 84 is a sleeve 86 having formed on the end thereof adjacent the head of the stud an external flange 85 and at the end remote therefrom an external flange 87. Mounted about the sleeve 86, between its flanges 85 and 87, reading from left to right in the drawings, is a centrally apertured annular disc-like element 88 which is basically formed of insulating material. Etched on the face of disc 88 which positions adjacent the flange 85 and the windshield W, to cover the same coextensively therewith, is a plate-like overlay 89 of copper. The overlay 89 is extended to line the aperture in the disc 88 and continued by a plate-like application 90 thereof, having a butterfly-type configuration, disposed to the opposite face of the disc 88. Immediately to the right of the unit 88–90 and bearing against the outermost surface of the butterfly shaped plate-like overlay 90 of copper material is one face of an annular disc 92 of insulating material forming an external flange on and in integral connection with one end of a sleeve 94 formed of insulating material which mounts about the sleeve 86, to which it is bonded using an ultrasonic weld. A conductive metal plate 96, having a central aperture, the configuration of which is similar to that of the plate-like overlay 90 receives through the central aperture thereof the sleeve 94 as it mounts with one face in abutting relation to the surface of the flange 92 the opposite surface of which is in bearing relation to the plate-like metallic overlay 90. In this embodiment of the invention, in interrelating the portion of the invention apparatus interiorly of the windshield W with the associated transceiver 26 the eyelet 98 in connection with the ground lead of the coaxial cable will be slipped over the sleeve 94 of insulating material to be abutted to and conductively related to the butterfly shaped conductive metal plate 96. This is followed on the sleeve 94 by a ring-shaped insulating washer 100. The length of the sleeve 94 is such to accommodate the mount thereon of only the elements 96, 98 and 100. Immediately to the right of the sleeve assembly comprised of parts 92–100 the stud 84 receives thereon the eyelet 58 in connection with the center lead in the related coaxial cable 60 which extends from the associated transceiver 26. As may be seen in FIG. 8, in the assembly thereof the eyelet 58 is clamped between the flange 87 and the adjacent extremity of the sleeve 86 which it abuts simultaneously with its overlapping abutment to the washer 100.

The arrangement is such that the elements 96, 98 and 100 are tightly clamped between the flange 92 on the one hand and the eyelet 58 and flange 87 on the other.

A jam nut 102 threadedly engaged about the inwardly projected extremity of stud 84 is used in an obvious fashion to fix the position of the assembly based on and including the sleeve 86 as and when a tuning is completed, with reference to the feed thru capacitor.

It is to be understood that the application of the elements mounting on the sleeve 86 will be in a sequence reverse to that just described. The flange 85 will not appear on the sleeve 86 until after the element 58 and the unit 92–94 mounting the elements 96, 98 and 100 is fixed in place with reference to the sleeve, and the disc unit 88–90 then applied over the end of the sleeve 86 remote from the flange 87. Following this the flange 85 will be formed by a swaging process to frictionally confine and fix the position of the disc 88–90 so that it will rotate with the sleeve 86 until such time the position of the latter is set by an abutment of the jam nut 102. While the unit 88–90 is coupled with sleeve 86 as stated, its frictional confinement is such that once sleeve 86 is fixed against rotation it may be per se rotated on and relative to the sleeve 86 and the other elements which are either bonded or clamped to the sleeve as previously described.

It will be seen from the foregoing description and drawings that, in the absence of or in a retracted position of jam nut 102, the sleeve 86 may be rotated directly or through the medium of the unit 88–90, which is frictionally coupled thereto, to provide for a change of the spacing between the outermost plate 30 and the plate-like structure 89, thereby to vary the capacitance of the feed thru capacitor of which they form a part. On the other hand, on application of the jam nut 102 on the inwardly projected end of the stud 84 to clamp against the flange 87 and fix the position of the sleeve 86 one can independently rotate the unit 88–90 and thereby change the rotational position of the plate-like portion 90 with reference to the conductive metal plate 96 the position of which is fixed by the installation which clamps the same against the flange 92 on the sleeve 94 which is bonded in turn to provide it with a fixed connection to the sleeve 86. As will be seen, the latter adjustment of the unit 88–90 will not change the capacitance which has been set for the feed thru capacitor formed by the plates 30 and 89 but it will change the capacity of the shunt capacitor. While the plate-like overlay 89 on one face forms part of the feed thru capacitor, the butterfly overlay 90 on the opposite face of the disc 88 forms one plate of a shunt capacitor the other plate of which is provided by the butterfly shaped conductive metal plate 96. In the case illustrated in the assembly of the elements on the sleeve 86 the plate 96 will be caused to be fixed in position with reference to the unit 92–94.

Thus the unit 88–90 is rotated with sleeve 86 to change the capacitance of the feed thru capacitor in the first instance and once the position of the sleeve is fixed the unit 88–90 may be differentially rotated, in the second instance, to change the capacitance of the shunt capacitor defined by the plates 90 and 96.

In summary, the two capacitor embodiment of the invention provides a means for tuning an antenna system which is not only simple to install but it also allows the antenna system to resonate at the operating frequency and insures that the impedance match of the antenna system to the coaxial cable which connects it to a related transceiver is optimum. What is so advantageous in this tuning arrangement is that both the feed thru capacitor and the shunt capacitor may be adjusted by simple and distinct rotations of the unit 88–90.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus providing for an installation of an antenna, particularly advantageous for use in connection with a transceiver in a mobile vehicle, comprising first and second means, each of which includes electrically conductive material, adapted to be mounted, without need for mechanical fasteners, in facing relation and in respective connection with inner and outer surfaces of a portion of a structure capable of providing a dielectric therebetween, the one of said means mounting to said outer surface providing for mount of an antenna in connection with the electrically conductive material thereof which forms one plate of a capacitor, the opposite plate of which is provided by the electrically conductive material of the other of said means which mounts to said inner surface and said other of said means being comprised of plural elements including one of stud-like form adapted to project generally perpendicular to said inner surface and a second, adapted for rotation on said element of stud-like form, which embodies therein said opposite plate which is conductively related to said element of stud-like form, and further including means for conductively relating said element of stud-like form to conductive means in connection with the transceiver.

2. Apparatus as in claim 1 characterized in that said second element is mounted for movement axially of said element of stud-like form, in response to rotation thereof, to vary the capacitance of said capacitor of which it forms a part.

3. Apparatus as in claim 1 wherein said plates of said capacitor have a non-circular configuration providing a change in the facing areas thereof as said second element is rotated on said element of stud-like form, whereby to vary the capacitance of said capacitor which said plates define in connection with said dielectric structure.

4. Apparatus as in claim 1, wherein said second element comprises a disc of electrically non-conductive material on one face of which is an overlay of electrically conductive material constituting said opposite plate, peripheral portions of said disc being in radially projecting relation to said overlay and accessible to the fingers of an operator to effect rotary turning movements of said second element.

5. Apparatus providing an installation of an antenna, particularly advantageous for use in connection with a transceiver in a mobile vehicle, comprising first and second means, each of which includes electrically conductive material, adapted to be mounted, without need for mechanical fasteners, in facing relation and in respective connection with inner and outer surfaces of a portion of a structure capable of providing a dielectric therebetween, the one of said means mounting to said outer surface providing for mount of an antenna in connection with the electrically conductive material thereof which forms one plate of a capacitor, the opposite plate of which is provided by the electrically conductive material of the other of said means which mounts to said inner surface, said other of said means including a stud-like device having means mounting said opposite plate thereon for axial displacement as well as for rotation relative thereto, said one plate and said opposite plate defining, with said dielectric structure, a feed thru capacitor and said stud-like device mounting in connected relation thereto an electrically conductive plate of non-circular peripheral configuration in spaced relation to a second electrically conductive plate of non-circular configuration, to define, with an interposed dielectric material, a second capacitor, one plate of said second capacitor being connected for movement conjointly with said opposite plate, the arrangement providing that upon the connection to said stud-like device, which is of electrically conductive material, of the leads of a coaxial cable extending from a related transceiver that said one plate and said opposite plate define a feed thru capacitor in series relation with the antenna which is mounted to said one of said means mounting to said outer surface of said dielectric structure and said non-circular plates provide a shunt capacitor, the arrangement providing that both said capacitors are variable.

6. Apparatus according to claim 5, wherein said opposite plate of said feed thru capacitor is embodied in a rotatable device carrying said one plate of said second capacitor and means are provided for rendering a rotary motion of said rotatable device alternatively effective and ineffective to effect an axial displacement of said opposite plate of said feed thru capacitor.

7. An antenna system for use in a mobile vehicle providing a transceiver accessible for operation by a vehicle occupant, including electrically conductive exterior and interior plates arranged to mount in an isolated relation to one another on opposite sides of vehicle structure functioning as a dielectric and to form therewith a feed thru capacitor, the exterior plate being fixed and arranged to mount an antenna, and the interior plate being arranged to be electrically connected to the transceiver and being part of an assembly forming with said exterior plate a feed thru variable capacitor, said assembly including means in operative connection with said interior plate accessible to and operable by a vehicle occupant to adjust the capacitance of the antenna system in conjunction with the operation of the transceiver.

8. An antenna system according to claim 7, wherein said assembly includes a shunt capacitor and both the feed thru capacitor and the shunt capacitor are subject to adjustment through the medium of said means in operative connection with said interior plate.

9. An antenna system according to claim 8 wherein said means in operative connection with said interior plate includes a rotatable disc made of an insulating material, an overlay of electrically conductive material on one side of said rotatable disc defines said interior plate and an overlay of electrically conductive material on the opposite side of said rotatable disc defines a plate of the shunt capacitor, said assembly including another electrically conductive plate means cooperative with the said last named overlay in forming the shunt capacitor.

10. An antenna system according to claim 8, wherein said means in operative connection with said interior plate is movable, in one operational mode in unison with other parts of said assembly and in another operational mode independently thereof, and said feed thru capacitor and said shunt capacitor are adjustable thereby in the respectively different operational modes, and means are included to establish said operational modes.

11. An antenna system according to claim 10, wherein said assembly includes a stud having a head portion, arranged to be fixed to a surface of said dielectric structure facing the interior of said vehicle, and an externally threaded shank portion projecting substantially perpendicularly therefrom, a sleeve in threaded engagement with said shank portion, a rotatable disc carried by said sleeve and frictionally coupled thereto, said disc providing said means in operative connection with said interior plate, said means to establish said operational modes includes a jam nut on said threaded shank portion of said stud which upon applying endwise pressure to said sleeve prevents it from partaking of a rotary motion of said rotatable disc and which upon releasing endwise pressure allows the sleeve to turn in unison with the rotatable disc, effecting an axial adjustment of said sleeve along the shank of said stud and of the rotatable disc carried thereby.

12. An antenna system according to claim 11, wherein said assembly further includes an electrically conductive overlay on a side of said rotatable disc, which overlay forms said interior plate and moves with said rotatable disc, with or relative to said sleeve, said overlay forming said electrically conductive interior plate having a configuration related to the configuration of said exterior plate such that the value of the feed thru capacitance it forms therewith will vary only upon rotary motion of said rotatable disc in which said sleeve moves in unison therewith and not upon independent rotary motion of said rotatable disc.

13. An antenna system according to claim 12, wherein said assembly further includes another electrically conductive overlay on the reverse side of said rotatable disc, a dielectric disc means in an adjacent relation to the side of said rotatable disc having said other overlay, and a further electrically conductive element at the side of said dielectric disc means away from said other overlay, said dielectric disc means being carried by and fixed to said sleeve, said other overlay and said further element defining said shunt capacitor and being configured so that the value of the shunt capacitance will vary only upon rotary motion of said rotatable disc independent of said sleeve, said rotatable disc and said dielectric disc means being confined on said sleeve against longitudinal motion relatively to one another and to said sleeve.

14. An antenna system according to claim 13 wherein said rotatable disc has a peripheral portion in radially projecting relation to said overlays thereon and accessible for finger tip contact for manual turning of said rotatable disc in its operational modes.

* * * * *

UNITED STATES PATENT AND TRADEMARK OFFICE

CERTIFICATE OF CORRECTION

PATENT NO. : 4,089,817

DATED : May 16, 1978

INVENTOR(S) : Dennis Kirkendall

It is certified that error appears in the above-identified patent and that said Letters Patent are hereby corrected as shown below:

First page, the reference to "14 Claims, 6 Drawing Figures" following the Abstract is corrected to read -- 14 Claims, 9 Drawing Figures --.

1st page, after "Assignee:", "Stephen A. Denmar" is corrected to read -- Stephen A. Denman, part interest --.

Col. 5, line 14, -- portion -- is inserted following "surface".

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*